US008424706B2

(12) United States Patent
Robertson et al.

(10) Patent No.: US 8,424,706 B2
(45) Date of Patent: Apr. 23, 2013

(54) CLOSURE WITH SEALING INSERT

(75) Inventors: Steven Gordon Robertson, East Ilsley (GB); Keith West, Grove (GB)

(73) Assignee: Crown Packaging Technology, Inc., Alsip, IL (US)

( * ) Notice: Subject to any disclaimer, the term of this patent is extended or adjusted under 35 U.S.C. 154(b) by 432 days.

(21) Appl. No.: 12/443,744

(22) PCT Filed: Sep. 26, 2007

(86) PCT No.: PCT/EP2007/060238

§ 371 (c)(1),
(2), (4) Date: Mar. 31, 2009

(87) PCT Pub. No.: WO2008/040671

PCT Pub. Date: Apr. 10, 2008

(65) Prior Publication Data

US 2010/0006574 A1 Jan. 14, 2010

(30) Foreign Application Priority Data

Oct. 2, 2006 (EP) ..... 06121614

(51) Int. Cl.
*B65D 53/00* (2006.01)

(52) U.S. Cl.
USPC ..... 220/378; 220/795; 220/796; 215/317; 215/341

(58) Field of Classification Search ..... 215/317, 215/318, 252, 341, 347; 220/378, 221, 795, 220/310.1, 796, 798, 265
See application file for complete search history.

(56) References Cited

U.S. PATENT DOCUMENTS

| | | | | |
|---|---|---|---|---|
| 3,017,048 | A | 1/1962 | Foye | |
| 3,061,132 | A * | 10/1962 | Geddes | 215/262 |
| 3,486,959 | A | 12/1969 | Podesta et al. | |
| 3,494,497 | A * | 2/1970 | Vercillo | 215/318 |
| 3,567,060 | A * | 3/1971 | Ballin | 215/11.6 |
| 3,690,497 | A * | 9/1972 | Lecinski, Jr. | 215/318 |
| 3,741,423 | A * | 6/1973 | Acton et al. | 215/318 |
| 4,279,353 | A | 7/1981 | Honma | |
| 4,576,299 | A * | 3/1986 | Lecinski, Jr. | 215/318 |
| 6,832,692 | B2 | 12/2004 | Ryall et al. | |
| 2002/0160137 | A1 | 10/2002 | Varma | |
| 2002/0175138 | A1 * | 11/2002 | Martin et al. | 215/318 |
| 2003/0015542 | A1 * | 1/2003 | Nulty et al. | 220/780 |
| 2011/0011866 | A1 * | 1/2011 | Dunwoody | 220/310.1 |

FOREIGN PATENT DOCUMENTS

| | | | |
|---|---|---|---|
| CH | 382010 | A | 9/1964 |
| DE | 2813940 | A1 | 10/1978 |
| FR | 1186787 | A | 9/1959 |
| FR | 2446235 | A1 | 8/1980 |

OTHER PUBLICATIONS

International Search Report and Written Opinion for International application No. PCT/EP2007/060238.

* cited by examiner

*Primary Examiner* — Mickey Yu
*Assistant Examiner* — Kareen Rush
(74) *Attorney, Agent, or Firm* — Woodcock Washburn LLP

(57) ABSTRACT

A closure (1) having a shell (10) and a polymer insert (20). The polymer material of the insert (20) is selected to be sufficiently soft to provide an adequate sealing surface (21) and yet sufficiently stiff to define legs (22), which clip behind the internal curl (11) of the closure shell (10).

16 Claims, 4 Drawing Sheets

CLOSURE WITH SEALING INSERT

TECHNICAL FIELD

Figure 1:
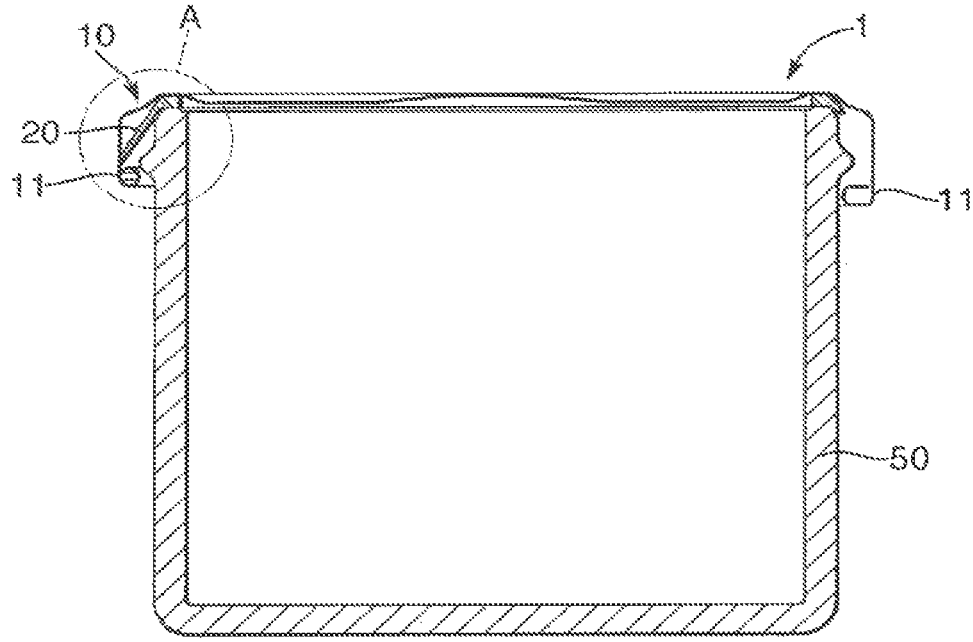

The present invention relates to closure caps, used to seal and reseal containers such as glass jars for example. In particular, the invention provides a closure cap, which incorporates a polymer insert to provide a sealing surface between the cap and the associated container. The invention is particularly suited for metal closure caps.

BACKGROUND ART

Conventionally, metal closures include an annulus of sealing compound, which is inserted into the closure after fabrication. A PVC organisol coating must be applied to the internal surface of the closure shell, to promote adhesion of the compound to the closure cap. The sealing compound is arranged to provide a sealing interface between the container and the closure. However, there has been growing concern about migration of chemicals from the sealing compound into the product held within the container. This has been a particular concern for containers of food product especially for containers of baby food. U.S. Pat. No. 6,832,692 seeks to overcome this problem by providing an insert having a gasket portion of soft pliant material, to provide sealing, and a tamper evident band of much stiffer material to provide rigidity to the insert. The insert is inserted into a metal closure shell. However, this closure is relatively expensive to manufacture and is not suitable for use with a simple metal twist-off closure or lug cap having an internal peripheral curl on the closure shell.

An alternative closure arrangement has been proposed in DE 2813940 and FR 79000608 utilising a resilient stopper and an outer cap adapted to lock the stopper onto a container neck. A disadvantage of these arrangements is that the outer cap must be destroyed upon first opening of the closure arrangement and therefore cannot be resealed on the container neck.

DISCLOSURE OF INVENTION

Accordingly, the present invention provides a resealable closure cap comprising a shell having a top and a peripheral skirt, the free edge of the peripheral skirt defining a radially inwardly extending rib and a polymer insert characterised in that the polymer insert provides a sealing surface and has a plurality of legs, which clip behind the rib of the shell to retain the polymer insert in the shell.

An advantage of this simplified closure cap construction is that the insert may be applied to a conventional twist-open metal lug cap having an internal peripheral curl on the closure shell and the closure shell remains intact upon opening of the closure cap. In fact, the internal curl is used to brace the insert within the shell and retain it therein during manufacture, transport, opening and re-closing. The insert provides the sealing surface and no PVC coating is required to promote adhesion of a sealing compound to the shell. In this arrangement, the closure may be twisted open to gain access to the contents of the container and thereafter resealed.

Furthermore, the insert may be made from a single polymer material having suitable stiffness to compromise between the softness required to obtain adequate sealing performance and the stiffness required to clip the insert into the closure shell and maintain it therein. Therefore, this closure cap may be seen as a lower cost alternative to the closure cap manufactured using the composite insert described in U.S. Pat. No. 6,832,692.

The insert material may be a polypropylene polymer, copolymer or blend of polypropylene with other olefinic polymers, copolymers, elastomers and includes thermoplastic elastomers (TPE). The material has a hardness in the range of Shore A 40 to Shore D 60. The modulus of the material as measured by flexural modulus may be in the range 30 MPa to 1200 MPa, preferably in the range 50 MPa to 600 MPa.

Preferably, the insert has at least 3 legs to ensure that it is level when clipped into the closure shell and is not "cocked" therein. This level sealing arrangement is important in the closure of the present invention because some of the sealing performance of the insert has to be compromised in order to mould the insert from a single polymer material. Thus, the sealing portion of the insert has to be soft enough to provide adequate sealing performance, whilst the leg portion must be of the required stiffness to clip and maintain the insert in the closure shell. More preferably, the insert has 5 or more legs to ensure stability of the insert within the closure shell even if the closure sustains impact.

An advantage of using a slightly stiffer material is that despite being clipped behind the internal curl, the insert is not fixed to the closure shell (in rotation) and may float within the shell making the closure easier to open. Whilst a softer sealing material provides enhanced sealing properties, friction may cause the insert to "stick" within the closure shell and thus slip-additives may have to be added to the polymer or a slip coating may be required in the inside of the closure shell.

However, under certain sealing conditions, it has been found that rough handling or transport of the closure cap may cause the insert to become misaligned in the closure shell, thereby affecting sealing performance. In these circumstances, the insert may be adhered to the inside of the shell by known techniques, such as adhesives or welding.

BRIEF DESCRIPTION OF FIGURES IN THE DRAWINGS

Figure 1A:
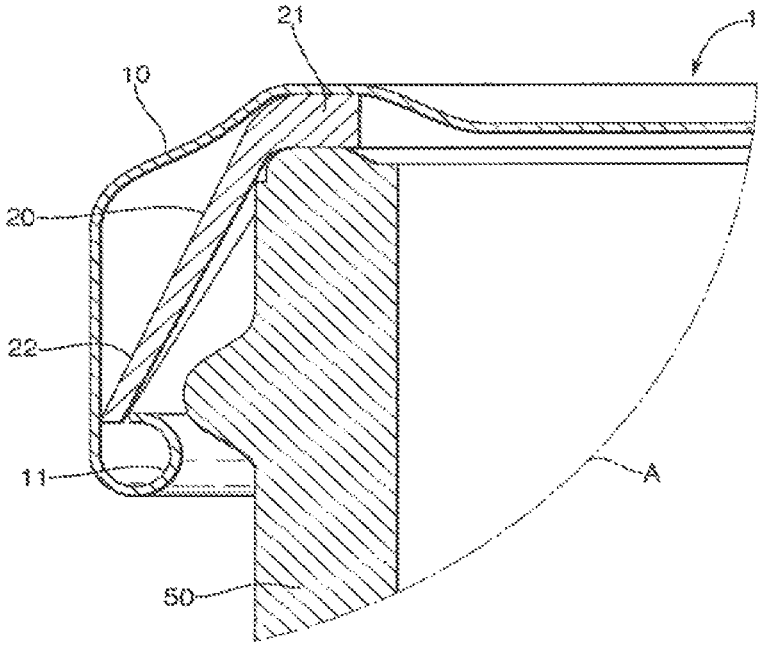
Figure 2:
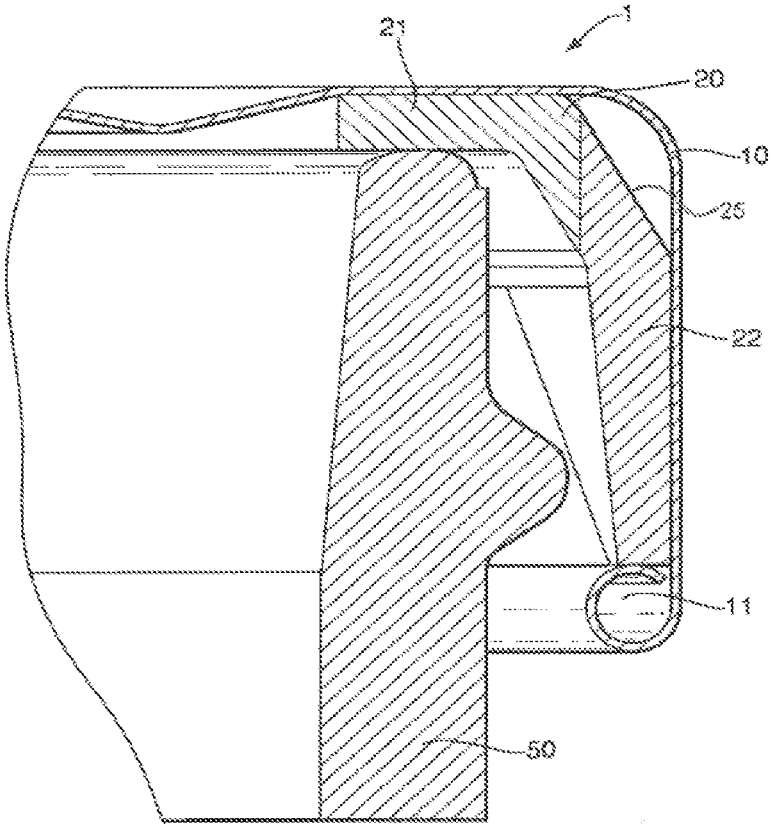
Figure 3A:
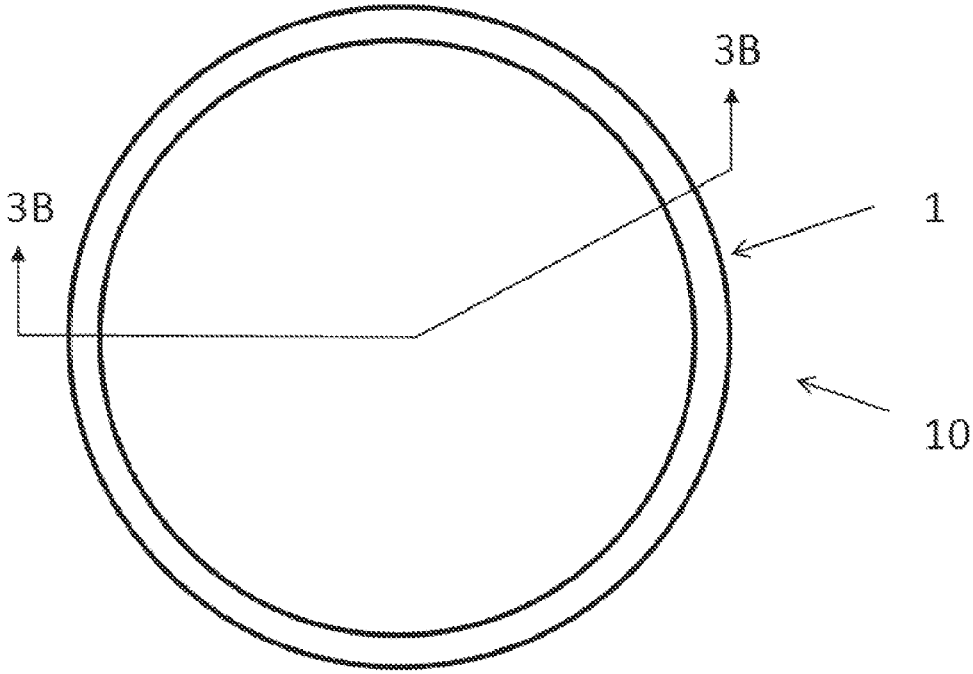
Figure 3B:
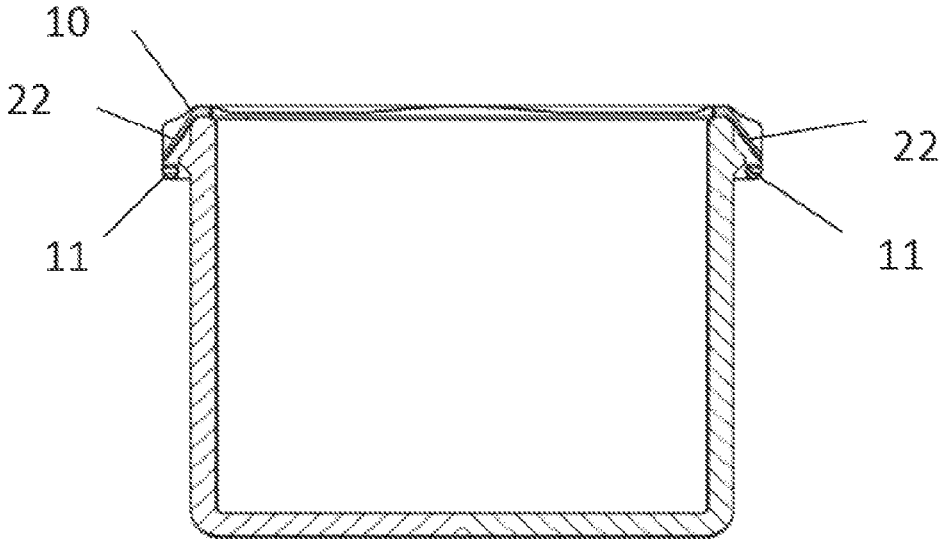
Figure 3C:
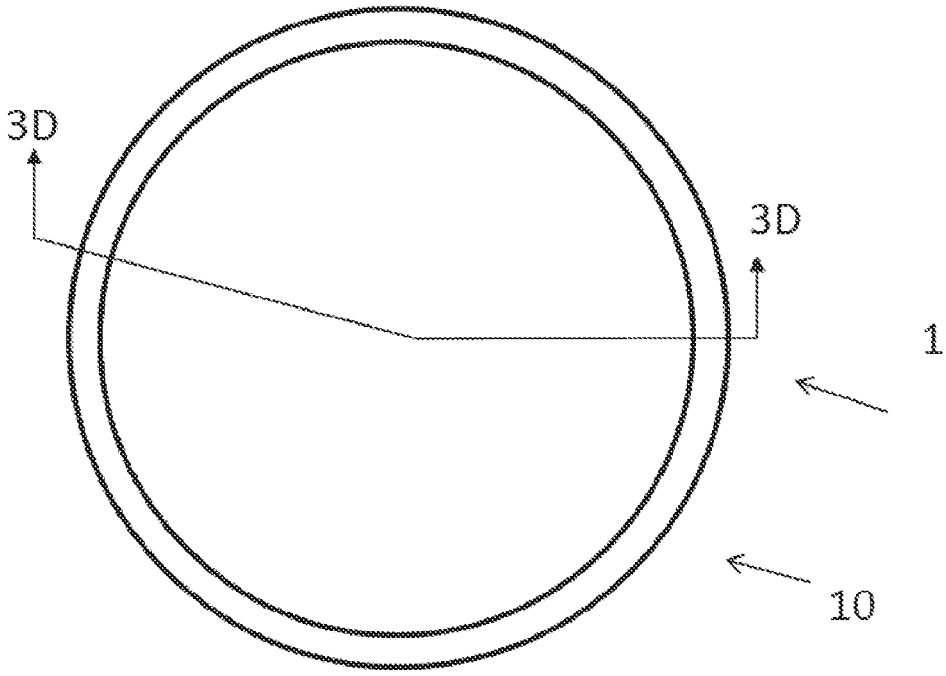
Figure 3D:
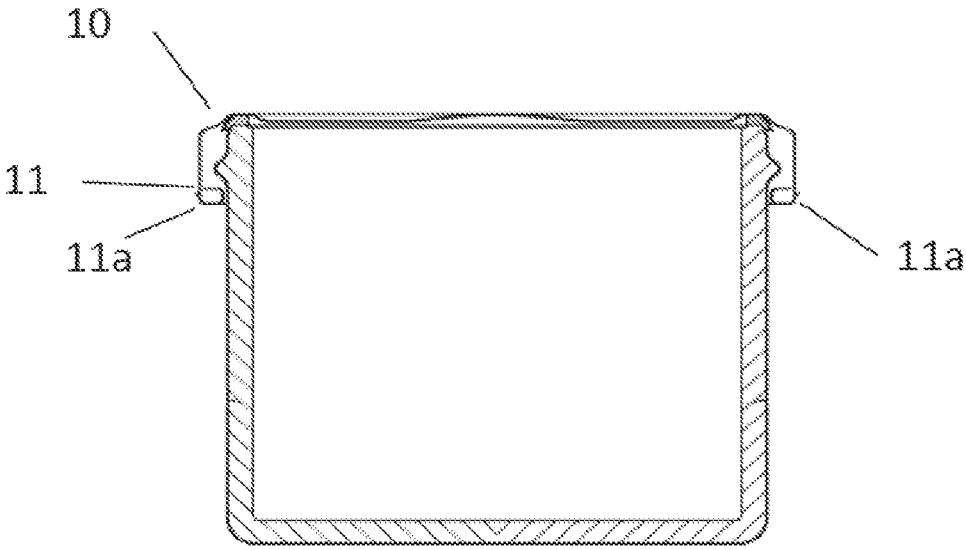

The present invention will now be described, by way of example only, with reference to the accompanying drawings in which:

FIG. 1 shows a side section through a closure according to a first embodiment of the invention, applied to a container, FIG. 1A is an enlarged side section view of the part A of FIG. 1, FIG. 2 shows a similar enlarged view to that shown in of an alternative embodiment of a closure according to the invention, FIG. 3A is a schematic (not to scale) of a top view of the first embodiment of the invention with a sectional line indicating the section schematic (not to scale) shown in FIG. 3B, and FIG. 3C is a schematic (not to scale) of the top view of the first embodiment of the invention with a different sectional line indicating the section schematic (not to scale) shown in FIG. 3D.

Wherever possible, like features have been given the same reference numerals in all of the figures.

Referring to FIGS. 1, 1A, and 3A-3D, a closure 1 comprises a metal closure shell 10 and a polymer insert 20 and is applied to a threaded container 50. The free edge of the metal shell 10 is finished with an internal curl 11. This curl 11 is modified at certain points around the circumference of the closure shell 10 to form lugs 11*a*. The closure 1 is opened and closed in the conventional way, using the lugs 11*a* on the closure shell 10 and a threaded container 50. The polymer insert 20 has a sealing portion 21, which is arranged to seal around the mouth of the container 50 and a leg portion 22, which is arranged to clip behind the internal curl 11. The diameter described by the free edge of the leg portion 22 is preferably slightly larger than the diameter described by the peripheral curl 11 of the closure shell 10 so that upon application of the insert 20 to the shell 10, the leg portion 22 is under stress and therefore, the insert 20 clips firmly into the closure shell 10 and will not become dislodged. The length of the leg portion 22 is also selected to be suitable in relation to the height of the closure shell 10 for this purpose.

FIG. 2 illustrates a similar closure 1 to that illustrated previously also applied to a container 50. In this embodiment, the sealing portion 21 and leg portion 22 are more defined and the leg portion 22 follows the internal contour of the closure shell 10 more closely. This ensures that there is less space for product entrapment and ensures that the assembled insert is more stable for capping. It can be seen from all the figures that the interface or transition 25 between the sealing portion 21 and the leg portion 22 is "cut away".

The provision of a "cut away" portion on the insert reduces the amount of polymer required to make the insert 20 and thus lowers to cost of the closure. The "cut away" portion also provides benefits for cooling the insert 20 post-moulding and lowers the incidence of moulding flaws. The "cut away" portion also increases the flexibility of the legs 22, which aids assembly of the polymer insert 20 into the closure shell 10 and assists with washing out the closure post application to a filled container 50. The "cut away" portion also provides ventilation of the closure and this prevents mould growth.

The invention claimed is:

1. A closure comprising:

a shell having a top and a peripheral skirt, a free edge of the peripheral skirt defining a radially inwardly extending curl, the curl including a plurality of inwardly extending lugs configured to mate with a threaded container, and a polymer insert including a sealing surface and a plurality of legs, which clip behind the curl of the shell to retain the polymer insert in the shell.

2. A closure according to claim 1, wherein the shell is made from a material comprising metal.

3. A closure according to claim 1, wherein the polymer insert has at least three legs.

4. A closure according to claim 1, wherein the polymer insert includes two portions: a sealing portion and a leg portion, and a transition between the sealing portion and the leg portion is cut away from the internal surface of the shell.

5. A closure according to claim 1, wherein the leg portion splays radially outwardly from the sealing portion.

6. A closure according to claim 1, wherein the sealing portion of the insert forms an annulus around a periphery of the internal surface of the top of the shell.

7. A closure according to claim 1, wherein the polymer insert is adhered to the internal surface of the shell.

8. A method of manufacture of a closure comprising the steps of:

preparing a metal closure shell having a top and a peripheral skirt, a free edge of the peripheral skirt defining a radially inwardly extending rib forming one or more lugs on the inwardly extending rib, the one or more lugs extending inwardly from the inwardly extending rib and being adapted to engage with a threaded container molding a polymer insert having a sealing surface and a plurality of legs, and assembling the polymer insert into the closure shell with the legs clipped behind the rib.

9. A method of manufacture of a closure according to claim 8, wherein the legs are stressed when the polymer insert is pressed into the shell securing the legs behind the rib.

10. The closure of claim 1 wherein the insert has a hardness in the range of Shore A 40 to Shore D 60.

11. The closure of claim 1 wherein the polymer insert is comprised of a material that has a flexural modulus in the range of 30 MPa to 1200 MPa.

12. The closure of claim 11 wherein the polymer insert is comprised of a material that has a flexural modulus in the range of 50 MPa to 600 MPa.

13. A resealable closure cap comprising:

a polymer insert including a sealing surface and a plurality of legs; and a shell having a top and a peripheral skirt, the peripheral skirt defining a radially inwardly extending curl, the curl further comprising a plurality of inwardly extending lugs configured to mate with a threaded container, and the curl being configured to hold the legs of the polymer insert to as to retain the polymer insert in the shell, wherein the polymer insert and shell define a cut-away portion that comprises a space between the shell and the insert.

14. The resealable closure cap of claim 13 wherein the insert has a hardness in the range of Shore A 40 to Shore D 60.

15. The resealable closure cap of claim 13 wherein the polymer insert is comprised of a material that has a flexural modulus in the range of 30 MPa to 1200 MPa.

16. The resealable closure cap of claim 15 wherein the polymer insert is comprised of a material that has a flexural modulus in the range of 50 MPa to 600 MPa.

* * * * *